United States Patent [19]

Rooney

[11] 4,022,366

[45] May 10, 1977

[54] SHEET HANDLING APPARATUS

[75] Inventor: Sidney C. Rooney, Vancouver, Canada

[73] Assignee: Durad Machine Company Ltd., New Westminster, Canada

[22] Filed: Mar. 22, 1976

[21] Appl. No.: 669,344

[52] U.S. Cl. ..... 226/91; 162/286; 162/289; 162/306; 162/363; 226/95; 226/97; 271/197

[51] Int. Cl.[2] ..... G03B 1/56

[58] Field of Search ..... 162/289, 286, 306, 363; 226/91, 95, 97; 271/98, 195, 197

[56] References Cited

UNITED STATES PATENTS

| | | | |
|---|---|---|---|
| 1,262,698 | 4/1918 | Pope | 162/306 |
| 1,369,124 | 2/1921 | Pope | 162/286 |
| 3,355,349 | 11/1967 | Devlin | 162/286 |
| 3,502,407 | 3/1970 | Granzow et al. | 226/97 |
| 3,712,558 | 1/1973 | Johnson et al. | 226/91 |

OTHER PUBLICATIONS

Baumann, "Variable Radius Air Bearing", IBM Technical Disclosure Bulletin, vol. 15, No. 6, Nov. 1972.

*Primary Examiner*—Robert L. Lindsay, Jr.

*Assistant Examiner*—George C. Yeung

*Attorney, Agent, or Firm*—Fulwider, Patton, Rieber, Lee & Utecht

[57] ABSTRACT

An apparatus for transporting a sheet of a flexible material between a first and a second position. The apparatus includes an elongated frame and an air-pervious endless belt movably mounted on first and second pulleys positioned at each end of the frame. The belt has its upper rung travelling from the first pulley, adjacent the first position, to the second pulley, adjacent the second position, and is arranged to receive a lead strip of the sheet from the first position. A vacuum chest having a perforated top extends longitudinally of and below the upper rung of the belt. There are means for evacuating air from the chest in order to apply a vacuum at the undersurface of the belt and thereby cause the lead strip to cling to the belt. The apparatus has means defining an opening where the sheet leaves the belt and an air jet means able to direct air through the opening. The air is directed contrary to the direction of movement of the belt and with a velocity sufficient both to overcome any gripping effect of air entrained within the air-pervious belt and to lift the sheet of flexible material.

8 Claims, 3 Drawing Figures

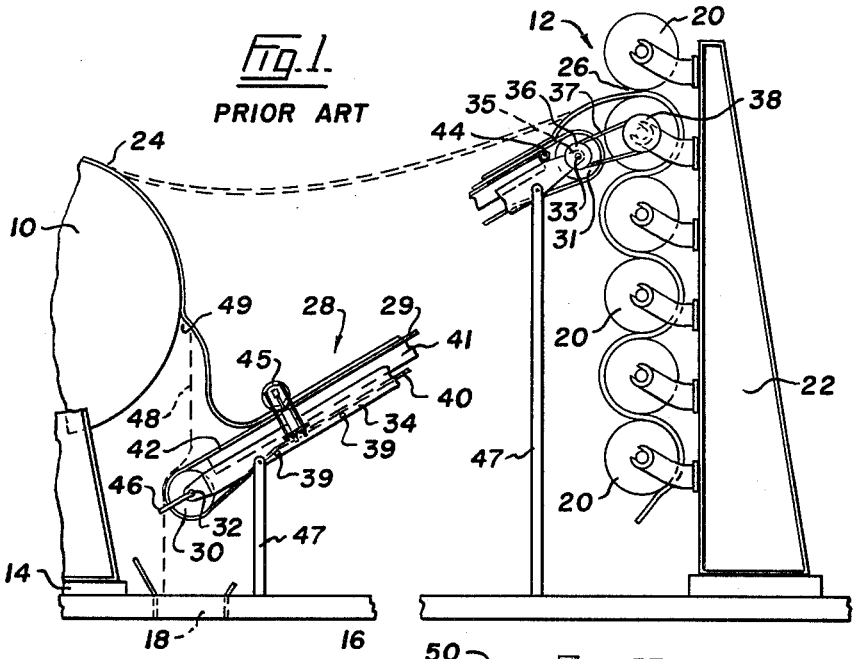
Fig. 1.
PRIOR ART
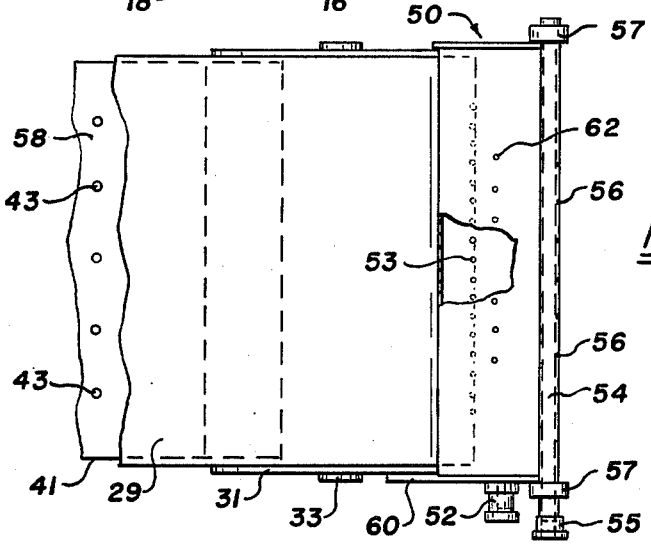
Fig. 2.
Fig. 3.
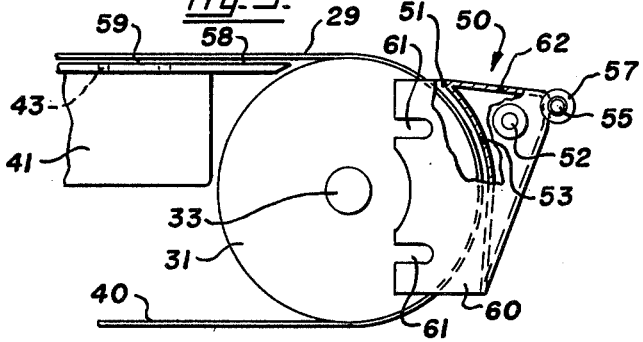

SHEET HANDLING APPARATUS

FIELD OF INVENTION

This invention relates to an apparatus for transporting a sheet of a flexible material between a first and a second position. In particular, and in a preferred embodiment, the invention provides an apparatus for transporting a lead strip of paper web from the dryer of a paper-making machine to the first pass of a calender of the machine.

DESCRIPTION OF PRIOR ART

U.S. Pat. No. 3,355,349 issued on Nov. 28, 1967 describes an apparatus for transporting a lead strip of paper web from the dryer of a paper-making machine and feeding into the first pass of the calenders of said machine. The apparatus comprises an elongated frame, a air-pervious endless belt movably mounted on the frame and having its upper run travelling from the dryer to the first pass of the calendars. The belt is arranged to receive the lead strip from the dryer. A vacuum chest having a perforated top extends longitudinally of and below the upper run of the belt. There are means for evacuating air from the chest so as to apply a vacuum at the undersurface of the belt and thus cause the lead strip to cling to the belt. Air blast means beneath, and extending transversely of, the upper run of the belt are positioned at the discharge end. These air blast means direct a blast of air upwardly through the belt to lift the lead strip from the belt and extend the lead strip towards the first pass of the calender. Thus, the apparatus described in the above United States patent is provided with means for ensuring that the lead strip is temporarily attached to the belt and with means to ensure that the lead strip can leave the belt at the appropriate time.

These contradictory requirements of the apparatus have provided difficulties.

The apparatus works well in most circumstances but it has been found that as the weight of the paper is reduced it is necessary to increase the under belt air blast pressure, that is the means for separating the paper web from the belt at the end of the run to maximum. Even then, increasing of this pressure was found inadequate for certain grades of paper, and single sheet tissue could not be projected at all and followed round he discharge pulley.

An analysis of this system indicated that at higher speed air entrained in the belt held the sheet to the pulley system. The present invention seeks to avoid this disadvantage and to provide an improvement in the apparatus of the above U.S. Pat. No. 3,355,349.

SUMMARY OF INVENTION

Accordingly, in one aspect, the present invention is an apparatus for transporting a sheet of a flexible material between a first and a second position, the apparatus including an enlongated frame, an air-pervious endless belt movably mounted on first and second pulleys positioned at each end of the frame, the belt having its upper rung travelling from the first pulley, adjacent the first position, to the second pulley, adjacent the second position, and arranged to receive a lead strip of the sheet from the first position, a vacuum chest having perforated top extending longitudinally of and below the upper rung of the belt, means for evacuating air from the chest in order to apply a vacuum at the undersurface of the belt and thereby cause the lead strip to cling to the belt, the improvement comprising means defining an opening where the sheet leaves the belt and an air jet means able to direct air through the opening in a direction contrary to the direction of movement of the belt and with a strength sufficient both to overcome any gripping effect of air entrained within the air-pervious belt and to lift the sheet of flexible material.

In a preferred embodiment, the above apparatus has a nose shoe disposed beyond the second pulley and spaced slightly from the second pulley to define the opening between the shoe and the second pulley an inlet into the shoe to receive a supply of air, a plurality of outlets disposed in the nose shoe adjacent the second pulley whereby an air jet may be directed through the opening and against the sheet in a direction contrary to the rotation of the second pulley.

The above apparatus has been found to be effective with paper of the heavier basis weights. The system is able to project such paper forward and, by varying the air flow, may control the angle of trajectory in relation to the belt face. However, lightweight tissues still give problems. Lightweight tissue has been found to fall over the end of the shoe out of control. Accordingly, in a further aspect of the invention the apparatus includes a second air jet means, downstream from the first air jet (that is the means able to direct air through the opening) the second air jet means being able to direct air downstream to act as a platform for the sheet. The second air jet means is preferably provided with holes that are small in diameter to give a velocity flow with minimum air volume. The tissue sheet will not fall through this air stream until the stream is too weak to provide support.

BRIEF DESCRIPTION OF DRAWINGS

The invention is illustrated, by way of example, in the accompanying drawings in which:

FIG. 1 is a partially exploded view illustrating the prior art;

FIG. 2 is a plan view of the modifications according to the present invention; and FIG. 3 is a side elevation of the modification illustrated in FIG. 2.

DESCRIPTION OF PREFERRED EMBODIMENT

In FIG. 1 an apparatus is illustrated comprising a dryer 10 and calenders 12. The dryer 10 and the calenders 12 are of known construction, forming no part of the present invention, so that their construction is shown somewhat diagrammatically.

The dryer 10 is mounted on a base 14 secured to the floor 16. The floor 16 is provided with an opening 18 which permits the paper web, in the event of a breakage, to pass downwardly through the floor into a waste bin (not shown) provided beneath the opening 18.

Calendars 12 comprise a plurality of rolls 20 mounted on a frame 22 one above the other. The paper web normally passes from the top 24 of the dryer 10 into a first pass 26 in the calenders 12. The dryers and calenders are both driven by conventional means (not shown) and are provided with conventional controls so that the peripheral speed of each of them may be synchronozed to control the tension in the web.

An endless belt type conveyor 28 extends between the dryer 10 and the calenders 12. The conveyor 28 carries the lead strip between the dryers 10 and the calenders 12.

At the calenders 12 the web is released to the first pass 26 so that it may be caught in the pass 26 and passed in the usual manner around the rolls 20 of the calenders 12.

The conveyor 28 comprises an endless belt 29 that extends between a pair of belt pulleys 30 and 32 mounted on shafts 32 and 33, respectively. Shaft 33 is secured for rotation between the opposite ends of a pair of spaced, parallel support frames 34 (only one of which is shown). Shaft 33 projects at one end 35 beyond the frame 34 and is provided with a small V-pulley 36 driven by a V-belt 37. The V-belt 37 passes over a V-pulley 38 which is secured concentrically to one of the calendar rolls for rotation with the roll. One of the V-pulleys 36 or 38 is of the variable diameter type so that the linear speed of the belt may be synchronized with the peripheral speed of the calender rolls.

Belt tensioners 39, which bear upwardly against a lower run 40 of the belt 29, are secured between the frames 34. The belt tensioners are of known construction and are not therefor described here.

Side frames 34 are connected to the vertical sides of an enlongated chest 41. Chest 41 is located between the lower run 40 of the belt 29 and its upper run 42. Chest 41 extends longitudinally of the conveyor belt 29 from a point adjacent pulley 30 to a point adjacent pulley 31. The chest has an upper wall located adjacent to and parallel to the upper run 42 of the belt. The upper wall is perforated. The perforations may take any desired form, for example, holes 43 (see FIG. 3).

The chest 41 is also provided with a conduit extending from a vertical side and is connected by suitable air line to a vacuum pump, an arrangement illustrated in U.S. Pat. No. 3,355,349. Extending transversely across the conveyor and located beneath the belt and between the chest 41 and the pulley 31 is a perforated pipe 44 which is connected by suitable conduits (not shown) to an air pump (not shown). The perforations in the pipe are arranged so that when air pressure is applied to the pipe the air blast issuing from the perforation will be directed in a direction upwardly against the underside of the belt and forwardly towards the calenders 12. The pipe 44 is held rigidly in place by brackets.

Roller 45 is secured to the side frame 34. As described in U.S. Pat. No. 3,355,349, the roller 45 is movable between a position in which the roller is pressed downwardly upon the belt and a position in which it is lifted upwardly from the belt.

The apparatus is also provided with a lead strip cutter 46.

Belt 29 is made of an air-pervious material, preferably a woven fabric. The weave is coarse so that the space between the warp and welt will freely permit the passage of air.

The conveyor 28 is supported on a framework 47 so that the belt 29, as it passes over pulley 30, lies inwardly of the vertical plane 48 shown in dashed lines in FIG. 1. The plane 48 represents the position assumed by the paper web when the web extends vertically downwardly from the periphery of the dryer 10 or from a doctor 49 as shown in FIG. 1.

In operation, the machine starts with the paper web delivered as far as the last dryer of the paper-making machine and running vertically downward from the doctor 49, through the opening 18 in the floor 16 and into waste.

A lead strip is formed in known manner at an edge of the web lying above the conveyor. Due to the weight of the paper, the lead strip passes over the upper run 42 of the belt 29 and over the end portion of the chest 41 adjacent pulley 30 and continue into the waste. The belt 29 is then placed in operation and the roller 45 extended transversely across the belt 29. Air pressure is supplied to pipe 44 and air is exhausted from chest 41. Vacuum created in the chest results in the lead strip adhering to the moving belt 29 and thus moving upwardly along the conveyor 28. The portion of the lead strip now in the waste bin is automatically severed by the cutter 46.

The lead strip is passed upwardly along the conveyor and under the roller 45. It is lifted from the belt by an air blast issuing from the pipe 44 which extends it towards the first pass 26 in the calenders 12.

When the grip of the calender upon the lead strip is assured, roller 45 is released and vacuum in the chest 41 is eliminated. The lead strip is then widened in a normal manner to the full width of the web.

As indicated above the use of the pipe 44 has certain disadvantages with the lower weights of paper. The present invention, which is illustrated in FIGS. 2 and 3, overcomes these disadvantages.

FIGS. 2 and 3 illustrate an embodiment of the present invention, which is a modification of the apparatus of FIG. 1 in that the pipe 44 is dispensed with and replaced by a shoe 50 spaced from the pulley 31 to define an opening 51. This shoe functions as a shaped air receiver to give maximum effect to air flow through jets 53 which make up a first air jet means. The shoe 50 is provided with an inlet 52 that is adapted to engage a source of compressed air. The shoe is provided with angled outlets 53 able to direct air through the opening 51 between the second pulley 31 and the shoe 50. The air is specifically directed in a direction contrary to the direction of movement of the belt 29, that is contrary to the direction of rotation of the pulley 31.

FIGS. 2 and 3 illustrate a preferred embodiment of the invention that is equipped with second air jet means in the form of a pipe 54 provided with an inlet 55 and with outlets 56 able to direct air downstream from the first air jet means to act as a platform for a sheet moving downstream of the shoe 50.

The pipe 54 is attached with collars 57, one at each end of the pipe 54. These collars 57 can be slackened on the pipe 54, for example, by the use of set screws (not shown), so that the direction of air forced from the outlets 56 in the pipe 54 can be varied. The relative position of the pulley 31 and of the upper surface 58 of the chest 41 should be noted. This positioning is such that there is a gap of approximately ⅛ inch at 59, that is between the belt and the upper surface 58 of the chest 41. Such a gap is important in order to enable the system to operate without vary rapid belt wear. The use of belt tensioners is also necessary to maintain the necessary clearance.

In an embodiment of the invention that has proved useful the shoe 50 was formed with seventeen outlets 53 each with a diameter of 1/32 inch. There were six outlets 56 each with a diameter of 1/16 inch. However, 1/32 inch diameter outlets 56 also provided good results, and even smaller outlets are preferred where they are adequate for the transfer. The inlets 52 and 55 were threaded ¼ inch normal pipe taper couplings. The vacuum chest cover 41 was a MICARTA plate. The upper surface of shoe 50 was inclined downwardly as illustrated in FIG. 3 at an angle of 5° from the horizontal. However, it should be emphasized that these dimensions are not essential. Variations in them will clearly be possible. It is simply essential that the amount of air issuing from the outlets 53 be sufficient both to overcome the effect of the air entrained within the pores of belt 29 and, also, to lift the web above the upper surface of the shoe 50.

The illustrated apparatus can be used without forcing air through the outlets 56. If the paper is relatively heavy it is found that the air jets through the outlets 56 in pipe 54 are not necessary. These air jets are only necessary with normal paper weights.

The air emitted through the outlets 53 is usually of a varying velocity and volume but is dependent upon the desired trajectory required of the sheet being transferred. Air emitted through the outlets 56 in pipe 54 is preferably of high velocity and low volume. By increasing the velocity of air the paper can be lifted higher.

The shoe 50 is provided with a bracket 60 formed with openings 61 so that it may be mounted on the apparatus.

A feature of the invention that can be particularly useful if there is a possibility of static electricity causing the paper to tend to cling to the shoe 50 is the provision of small outlets 62 in the upper surface of the shoe 50. The holes 62 may direct air at an angle to the surface or normal to the surface to overcome any tendency of certain types of paper being attracted to the surface by electrostatic charge.

The device of the present invention can be used wherever it is desired to move a sheet of flexible material, particularly paper, across a gap. This can be done simply because it is required to move the sheet across a gap between parts of a machine or it may be done deliberately, for example, to scan a sheet of paper. The invention is of particular importance where it is required to project a paper tail across an opening over which a scanner is positioned and send it to a position where the tail can be picked up and fed to a reel.

I claim:

1. In an apparatus to transporting a sheet of dry paper between two structures spaced from each other, the apparatus including an elongated frame, an air-pervious endless belt movably mounted on first and second pulleys positioned at each end of the frame, the belt having its upper rung travelling from the first pulley, adjacent one structure, to the second pulley, adjacent the other structure, and arranged to receive a lead strip of the sheet from the one structure, a vacuum chest having a perforated top extending longitudinally of and below the upper rung of the belt, means for evacuating air from the chest in order to apply a vacuum at the undersurface of the belt and thereby cause the lead strip to cling to the belt, the improvement comprising:

a nose shoe disposed beyond the second pulley and spaced slightly from the second pulley to define an opening between the shoe and the second pulley where the sheet leaves the belt, an inlet into the shoe to receive a supply of air, at least one first air jet means disposed in the nose shoe adjacent the second pulley whereby a first air jet may be directed into the opening and against the sheet in a direction contrary to the rotation of the second pulley sufficient both to overcome any gripping effect of air entrained within the air-pervious belt and to lift the sheet of flexible material; and second air jet means attached to the nose shoe on that side of the shoe remote from the second pulley, and able to direct air downstream of the shoe to act as a platform for the sheet.

2. An apparatus as claimed in claim 1 in which the second jet means is a pipe formed with at least one opening, the nose shoe being provided with collars at each side to rotatably receive the pipe and means to lock the pipe into a predetermined position in the collars.

3. An apparatus as claimed in claim 1, in which the first air jet means is of adjustable varying velocity and adjustable varying volume.

4. An apparatus as claimed in claim 3, in which the first air jet means comprises a plurality of holes disposed substantially parallel to the axis of rotation of the second pulley.

5. Apparatus as claimed in claim 1, in which the second air jet means is able to eject air at high velocity but low volume.

6. Apparatus as claimed in claim 1, in which the shoe includes a bracket to permit its mounting on the apparatus.

7. Apparatus as claimed in claim 1, in which the first and second pulleys are positioned to ensure a clearance of approximately ⅛ inches between the belt and the upper surface of the vacuum chest.

8. Apparatus as claimed in claim 7, provided with tensioners to assist in the maintenance of the clearance.

* * * * *